US005549810A

United States Patent [19]

Herklotz et al.

[11] Patent Number: 5,549,810

[45] Date of Patent: Aug. 27, 1996

[54] BATH FOR THE ELECTRODEPOSITION OF PALLADIUM-SILVER ALLOYS

[75] Inventors: Günter Herklotz, Bruchköbel; Thomas Frey, Hanau; Otto Camus, Erlensee, all of Germany

[73] Assignee: W.C. Heraeus GmbH, Hanau, Germany

[21] Appl. No.: 503,589

[22] Filed: Jul. 18, 1995

[30] Foreign Application Priority Data

Jul. 21, 1994 [DE] Germany ..... 44 25 813.5
Dec. 13, 1994 [DE] Germany ..... 44 44 232.7

[51] Int. Cl.[6] ..... C25D 3/56

[52] U.S. Cl. ..... 205/259; 205/257; 205/260

[58] Field of Search ..... 205/260, 259, 205/257

[56] References Cited

U.S. PATENT DOCUMENTS

| | | | |
|---|---|---|---|
| 4,066,517 | 1/1978 | Stevens et al. | 205/257 |
| 4,126,524 | 11/1978 | Hradil et al. | 205/258 |
| 4,673,472 | 6/1987 | Morrissey et al. | 205/257 |

FOREIGN PATENT DOCUMENTS

| | | |
|---|---|---|
| 0073236 | 3/1983 | European Pat. Off. . |
| 0059452 | 10/1985 | European Pat. Off. . |
| 1221874 | 7/1966 | Germany . |
| 3935664 | 3/1991 | Germany . |
| 649582A5 | 5/1985 | Switzerland . |

OTHER PUBLICATIONS

B. Sturzenegger et al, "Electrodeposition of Palladium–Silver Alloys from Ammoniacal Electrolytes", *Platinum Metals Review*, vol. 28, No. 3, (1984) 117–124, Johnson Matthey Public Limited Company, Hatton Garden, London.

*Primary Examiner*—John Niebling
*Assistant Examiner*—Kishor Mayekar
*Attorney, Agent, or Firm*—Frishauf, Holtz, Goodman, Langer & Chick, P.C.

[57] ABSTRACT

Aqueous ammoniacal baths containing polyamines and mercaptoalkane carboxylic acids and/or mercaptoalkane sulfonic acids for the electrodeposition of palladium-silver alloys are provided, which are particularly suited as electrical contacts. The baths have very good stability and permit the deposition of alloys with a silver content up to approximately 99 weight %.

20 Claims, No Drawings

BATH FOR THE ELECTRODEPOSITION OF PALLADIUM-SILVER ALLOYS

BACKGROUND

1. Field of the Invention

The invention relates to an ammoniacal bath for the electrodeposition of palladium-silver alloys, containing a complex-bonded palladium, a silver compound and a mercapto compound.

2. Background Information

German Patent No. 1 221 874 relates to a method for the electrodeposition of pore-free palladium-silver coatings (thickness approximately 5 to 100 micrometers) from an ammoniacal palladium/nitrate and silver nitrate solution with a pH value of 7.5 to 11, at a temperature of 35° to 90° C., at a current density of 1 to 10 mA/cm$^2$ and at a voltage of 0.5 to 7 volts. Good results are obtained if the solution in German Patent No. 1 221 874 contains 0.5 to 10 g of the metal(s) per liter of solution. However, it is also possible to employ solutions with up to 150 g and more of metal per liter.

Swiss Patent No. 649 582 describes a bath for electroplating of substrates with palladium or palladium alloys at a temperature of 20° to 75° C. and at a current density of 0.1 to 10 A/dm$^2$. Swiss Patent No. 649 582 is distinguished in that it has a pH value of 6.5 to 9.5, buffered by ammonium/borate, amine/borate or alkaline metal borate, to prevent the undesirable precipitation of palladium or of the alloy metal (copper, cobalt, cadmium, gold, iron, indium, nickel, silver, tin, zinc) during the operation. The bath in Swiss Patent No. 649 582 contains 1 to 50 g/l of palladium in the form of a palladium-ammine complex (palladium(II)-di or-tetra-ammine complex), 0 to 20 g/l of the alloy metal, 10 to 50 g/l of borate and possibly up to 5 g/l of a brightener of an aromatic sulfonated imide or amide, aromatic alkaline metal sulfonate and/or aromatic sulfonic acid.

A similar bath is known from *Platinum Metals Review,* (1984), 28(3), 117 to 124. It contains palladium and silver in the form of ammine complexes Pd $(NH_3)_4(NO_3)_2$ and $Ag(NH_3)_2NO_3$ and has a pH value of 11.5.

EP 0 059 452 B1 and EP 0 073 236 B1 relate to methods for the electrodeposition of coatings of palladium and its alloys with silver, copper and/or nickel from baths containing complexes of palladium with aliphatic polyamines (1,3-diaminopropane, N,N,N',N'-tetramethylethylene diamine, 2-hydroxy-1,3-diaminopropane) as a palladium source and have a pH value between 7.5 and 13.5. A particular aqueous bath for electrodeposition of the palladium-silver alloys is composed of 69.6 g/l of silver(I)-oxide, 53.2 g/l of palladium(II)-chloride, 222 g/l 1,3-diaminopropane, 106.2 g/l of $K_3PO_4$ and 86.5 g/l of $K_2HPO_4$ and has a pH value of 11.3, set with KOH or $H_3PO_4$. The bath temperature is between 40° and 65° C. and the current density is between 1.1 and 538 mA/cm$^2$. The palladium-silver alloys are particularly suited as surfaces for electrical contacts.

German Patent Publication DE 39 35 664 C1 concerns an aqueous ammoniacal bath with a pH value above 8 for electrodeposition of palladium-silver alloys, in which palladium and silver are provided in the form of ammine complexes. Besides 5 to 50 g/l of palladium and 2 to 40 g/l of silver, the bath contains 1 to 50 g/l of an aliphatic or aromatic mercapto compound (mercapto acetic acid, mercapto propionic acid, mercapto succinic acid, thioglycerol, thiophenol, thiosalicylic acid) as brighteners and, if required, additionally the amide of an aliphatic carboxylic acid, by means of which the possible occurrence of black, silver-containing precipitates in the bath can be prevented to a great extent. Furthermore, borate and, as a conductive agent ammonium phosphate, ammonium acetate and/or ammonium nitrate, can be contained in the bath. Bright, ductile and pore- and crack-free coatings of palladium-silver alloys with up to 40 weight-% silver can be deposited from this bath at room temperature, and are particularly suited as contact layers for electrical contacts.

SUMMARY OF THE INVENTION

It is the object of the present invention to provide a bath for depositing contact layers of palladium-silver alloys suitable for electrical contacts, with a higher silver proportion. It is a further object of the present invention to provide a bath for use at room temperature, as well as at higher temperatures—in that case higher deposition speeds are possible—and should permit long operating times, without the formation of black, silver-containing precipitates. It is a still further object of the present invention to provide a bath for use in barrel plating, as well as in reel to reel plating.

The present invention fulfills the aforesaid objects, as well as other objects, aims and advantages.

The present invention concerns an aqueous bath for the electrodeposition of palladium-silver alloys, which comprises:

5–50 g/l of palladium in the forth of a palladium-ammine complex,

2–40 g/l of silver in the form of a silver compound,

30–150 g/l of a conductive agent,

5–100 g/l of an amine component or at least one aliphatic polyamine with 2 to 10 amino groups in the molecule, and 2–50 g/l of a water-soluble mercaptoalkane carboxylic acid and/or a water-soluble mercaptoalkane sulfonic acid and/or their water-soluble salts, having a pH value of 7.0 to 10.0, set by means of ammonium hydroxide.

A preferred aqueous bath according to the present invention contains the following:

5–20 g/l of palladium in the form of a palladium-ammine complex,

2–30 g/l of silver in the form of a silver compound,

50–100 g/l of a conductive agent,

5–100 g/l of an amine component of at least one aliphatic polyamine with 2 to 10 amino groups in the molecule, and 2–20 g/l of water-soluble mercaptoalkane carboxylic acid and/or water-soluble mercaptoalkane sulfonic acid and/or their water-soluble salts, having a pH value of 7.0 to 10.0 set by means of ammonium hydroxide.

For preparing the bath, palladium diamine dichloride, palladium diamine dibromide or palladium diamine dinitrite are well suited as the palladium-ammine complex. The silver compound may be silver chloride, silver nitrate, silver sulfate or a silver-diamine complex. The preferred palladium-ammine complex is palladium diamine nitrite the preferred silver compound is silver and nitrate.

The amine component includes polyamines and derivatives of the polyamines, such as hydroxy- and carboxy-polyamines. Preferred amine components are as follows:

(i) alkylene diamines with 2 to 6 C atoms in the alkylene group, in particular ethylene diamine, hexamethylene diamine, and a mixture of ethylene diamine and hexamethylene diamine (ii) polyethylene amines of the general formula $NH_2(CH_2CH_2NH)_nH$ with n=2 to 5, in particular diethylene triamine, triethylene tetramine, pentaethylene hexamine and mixtures thereof, and (iii) the polyamine derivatives bis-(2-hydroxy-3-aminopropyl)-amine, N-(2-aminoethyl)-1,3-diaminopropane and ethylene-diaminetetra acetic acid.

The amine component can consist of one or several polyamines. An increase in the silver content of the deposited palladium-silver alloys can be surprisingly achieved by the use a polyamine mixture (see the examples set forth hereinbelow).

Carboxylic acids, such as tartaric acid and citric acid or their salts, boric acid and ammonium salts of inorganic acids, such as ammonium bromide, ammonium chloride, ammonium nitrate and ammonium sulfate are particularly suited as conductive agent, wherein the conductive agent can include one or several of these compounds.

Preferred mercapto acids include 2- and 3-mercaptopropionic acid and 3-mercaptopropane sulfonic acid. They can be used for the preparation of the bath either individually or in mixtures thereof and as free acids and/or in the form of their salts, particularly preferred are alkali metal and ammonium salts.

The bath can be maintained at temperatures between 20° and 80° C. Current densities up to approximately 20 A/dm$^2$ can be employed; current densities between 0.5 and 10 A/dm$^2$ are preferred. An increase of the pH value and/or the bath temperature—at a given palladium and silver concentration in the bath—allows the deposition of palladium-silver alloys with a higher silver content.

The bath can be replenished by the addition of the palladium and silver compounds used for its preparation or, regarding its silver concentration, also by the employment of soluble silver anodes.

Surprisingly, the bath in accordance with the invention is very stable, even if it is maintained at a higher temperature than room temperature. With the appropriate replenishment of the components constituting the bath, the bath can be maintained for several months without the formation of a black, silver-containing precipitate. As shown by comparison tests hereinbelow, these very good properties, which are characteristic of the bath, are based on the combined action (synergistic effect) of the amine component with the mercapto acid.

The bath can be used for electrodeposition of small parts, as well as tapes and wires, and allows for the deposition of alloys with a silver content of up to 99 weight %.

The deposited palladium/silver coatings are bright, ductile and free of pores and cracks and are therefore particularly suited as contact layers for electrical contacts.

EXAMPLES

To explain the invention in greater detail, baths in accordance with the invention will be described below by means of Examples 1 to 10, and known baths and the deposition of coatings of palladium-silver alloys therefrom are described in Examples 11 and 12 (comparison examples).

Example 1

An aqueous solution is prepared from 20 g/l palladium in the form of $Pd(NH_3)_2(NO_2)_2$, 5 g/l silver in the form of $AgNO_3$, 70 g/l tartaric acid, 22.5 g/l ethylenediamine, and 9.6 g/l 2-mercaptopropionic acid and the pH value of the solution is set to 8 by the addition of ammonium hydroxide.

Example 2

7 g/l triethylenetetramine and ammonium hydroxide are added to the aqueous solution described in Example 1 until a pH value of 8 is achieved.

Example 3

20 g/l triethylenetetramine and ammonium hydroxide are added to the aqueous solution described in Example 1 until a pH value of 8 is achieved.

Bright, ductile and pore- and crack-free palladium/silver coatings of various compositions are deposited from the baths in accordance with Examples 1 to 3 at a bath temperature of 35° C. and a mean current density of 2 A/dm$^2$ (see Table I) .

TABLE I

| Example | Ethylenediamine/ Triethylenetetr-amine [g/g] | pH Value | Pd/Ag (weight %) Pd | Ag |
|---|---|---|---|---|
| 1 | 22.5:0 | 8 | 81 | 19 |
| 2 | 22.5:7 | 8 | 72 | 28 |
| 3 | 22.5:20 | 8 | 55 | 4 |

Example 4

An aqueous solution is prepared from 10 g/l palladium in the form of $Pd(NH_3)_2(NO_2)_2$, 5 g/l silver in the form of $AgNO_3$, 60 g/l $NH_4NO_3$, 18 g/l ethylenediamine, and 4.8 g/l 2-mercaptopropionic acid and the pH value of the solution is set to 7.5 by the addition of ammonium hydroxide.

Example 5

7 g/l triethylenetetramine and ammonium hydroxide are added to the aqueous solution described in Example 4 until a pH value of 7.5 is achieved.

Example 6

20 g/l triethylenetetramine and ammonium hydroxide are added to the aqueous solution described in Example 4 until a pH value of 7.5 is achieved.

Example 7

234 g/l triethylenetetramine and ammonium hydroxide are added to the aqueous solution described in Example 4 until a pH value of 7.5 is achieved.

Bright, ductile and pore- and crack-free palladium/silver coatings of various compositions are deposited from the baths described in Examples 4 to 7 at a bath temperature of 35° C. and a mean current density of 2 A/dm$^2$ (see Table II).

TABLE II

| Example | Ethylenediamine/ Triethylenetetr-amine [g/g] | pH Value | Pd/Ag (weight %) Pd | Ag |
|---|---|---|---|---|
| 4 | 18:0 | 7.5 | 75 | 25 |
| 5 | 18:7 | 7.5 | 73 | 27 |
| 6 | 18:20 | 7.5 | 70 | 30 |
| 7 | 18:34 | 7.5 | 65 | 35 |

Example 8

An aqueous solution is prepared from 10 g/l palladium in the form of $Pd(NH_3)_2(NO_2)_2$, 5 g/l silver in the form of $AgNO_3$, 80 g/l $NH_4NO_3$, 20 g/l triethylenetetramine, and 4.8 g/l 2-mercaptopropionic acid.

The pH value is set to 7.5, 8.5 or 9.5 by the addition of ammonium hydroxide. The deposition of bright, ductile and pore- and crack-free palladium/silver coatings takes place at bath temperatures of 25° C. and 50° C. and a mean current density of 2 A/dm$^2$.

Table III shows the dependence of the silver content of the deposited palladium/silver coatings on the pH value and the temperature of the bath.

TABLE III

| pH Value | Bath Temperature [°C.] | Pd/Ag (weight %) Pd | Ag |
|---|---|---|---|
| 7.5 | 25 | 85 | 15 |
| 8.5 | 25 | 72 | 28 |
| 9.5 | 25 | 59 | 41 |
| 7.5 | 50 | 75 | 25 |
| 8.5 | 50 | 57 | 43 |
| 9.5 | 50 | 43 | 57 |

Example 9

An aqueous solution is prepared from 10 g/l palladium in the form of $Pd(NH_3)_2(NO_2)_2$, 5 g/l silver in the form of $AgNO_3$, 80 g/l $NH_4NO_3$, 28.5 g/l diethylenetriamine, 8.5 g/l pentaethylenehexamine, and 4.8 g/l 2-mercaptopropionic acid The pH value is set to 7.5, 8.5 or 9.5 by the addition of ammonium hydroxide. The deposition of bright, ductile and pore- and crack-free palladium/silver coatings takes place at bath temperatures of 25° C. and 50° C. and a mean current density of 2 A/dm$^2$. Table IV shows the dependence of the silver content of the deposited palladium/silver coatings on the pH value and the temperature of the bath.

TABLE IV

| pH Value | Bath Temperature [°C.] | Pd/Ag (weight %) Pd | Ag |
|---|---|---|---|
| 7.5 | 25 | 80 | 20 |
| 8.5 | 25 | 60 | 40 |

TABLE IV-continued

| pH Value | Bath Temperature [°C.] | Pd/Ag (weight %) Pd | Ag |
|---|---|---|---|
| 9.5 | 25 | 40 | 60 |
| 7.5 | 50 | 61 | 39 |
| 8.5 | 50 | 43 | 57 |
| 9.5 | 50 | 35 | 65 |

Example 10

An aqueous solution is prepared from 7 g/l palladium in the form of $Pd(NH_3)_2(NO_2)_2$, 20 g/l silver in the form of $AgNO_3$, 30 g/l ammonium nitrate, 10 g/l boric acid, 7 g/l diethylenetriamine, and 20 g/l 3-mercaptopropane sulfonic acid and the pH value is set to 8.7 by the addition of ammonium hydroxide. At a bath temperature of 25° C. and a mean current density of 1 A/dm$^2$ silky, ductile and pore- and crack-free palladium/silver coatings with 2 weight % of palladium are deposited.

Example 11 (Comparison Example)

An aqueous solution is prepared from 20 g/l palladium in the form of $PdCl_2(NH_3)_2$, 5 g/l silver in the form of $AgNO_3$, 40 g/l ammonium phosphate, 30 g/l boric acid, and 12 g/l 2-mercaptopropionic acid and the pH value is set to 9.5 with ammonium hydroxide. At a bath temperature of 25° C. and a mean current density of 2 A/dm$^2$ bright, ductile and pore- and crack-free palladium/silver coatings are deposited. A black precipitate forms in the bath after a few hours.

Example 12 (Comparison Example)

An aqueous solution is prepared from 20 g/l palladium in the form of $PdCl_2(NH_3)_2$, 5 g/l silver in the form of $AgNO_3$, 40 g/l ammonium phosphate, 30 g/l boric acid, 12 g/l 2-mercaptopropionic acid, and 10 g/l succinic acid monoamide and the pH value is set to 9.5 with ammonium hydroxide. At a bath temperature of 25° C. and a mean current density of 2 A/dm$^2$ bright, ductile and pore- and crack-free palladium/silver coatings are deposited. No black precipitate is formed. At a bath temperature of 35° C. and a mean current density of 2 A/dm$^2$ bright, ductile and pore- and crack-free palladium/silver coatings are also deposited. A black precipitate forms in the bath after a few hours.

Various changes and modifications may be made, and features described in connection with any one of the embodiments may be used with any of the other, within the scope of the inventive concept.

We claim:

1. An aqueous ammoniacal bath for the electrodeposition of palladium-silver alloys, which comprises:

5–50 g/l of palladium ions in the form of a palladium-ammine complex,

2–40 g/l of silver ions in the form of a silver compound selected from the group consisting of silver chloride, silver nitrate, silver sulfate and a silver-diammine complex, 30–150 g/l of a conductive agent, 5–100 g/l of an amine component comprising at least one aliphatic polyamine with 2 to 10 amine groups in the molecule and being selected from the group consisting of alkylene diamine with 2 to 6 C atoms in the alkylene group and polyethylene amine of the formula $NH_2(CH_2CH_2NH)_nH$ with n=2 to 5, and 2–50 g/l of at least one water-soluble mercaptoalkane compound selected from the group consisting of mercaptoalkane carboxylic acid, mercaptoalkane sulfonic acid and a salt of said mercapto acids, and has a pH value of 7.0 to 10.0, set by means of ammonium hydroxide.

2. The bath of claim 1, wherein the bath comprises:

5–20 g/l of the palladium ions in the form of the palladium-ammine complex,

2–30 g/l of the silver ions in the form of the silver compound selected from the group consisting of silver chloride, silver nitrate, silver sulfate and a silver-diammine complex, 50–100 g/l of the conductive agent, 5–100 g/l of the amine component comprising the at least one aliphatic polyamine with 2 to 10 amine groups in the molecule and being selected from the group consisting of alkylene diamine with 2 to 6 C atoms in the alkylene group and polyethylene amine of the formula $NH_2(CH_2CH_2NH)_nH$ with n=2 to 5, and 2–20 g/l of the at least one mercaptoalkane compound selected from the group consisting of mercaptoalkane carboxylic acid, mercaptoalkane sulfonic acid and a salt of said mercapto acids.

3. The bath of claim 1, wherein the palladium-ammine complex is selected from the group consisting of palladium diammine dichloride, palladium diamine dibromide and palladium diammine dinitrite.

4. The bath of claim 1, wherein the polyamine is an alkylene diamine which is selected from the group consisting of ethylene diamine, hexamethylene diamine and a mixture of ethylene diamine and hexamethylene diamine.

5. The bath of claim 1, wherein the polyamine is a polyethylene amine which is selected from the group consisting of diethylene triamine, triethylene tetramine, pentaethylene hexamine and mixtures thereof.

6. The bath of claim 1, wherein the polyamine is a mixture of ethylene diamine and triethylene tetramine.

7. The bath of claim 1, wherein the conductive agent is a carboxylic acid or a salt thereof.

8. The bath of claim 1, wherein the conductive agent is an ammonium salt of an inorganic acid.

9. The bath of claim 1, wherein the mercaptoalkane compound is selected from the group consisting of 2-mercaptopropionic acid and 3-mercaptopropionic acid.

10. The bath of claim 1, wherein the mercaptoalkane compound is 3-mercaptopropane sulfonic acid.

11. The bath of claim 3, wherein the conductive agent is selected from the group consisting of a carboxylic acid, a salt of a carboxylic acid and an ammonium salt of an inorganic acid.

12. The bath of claim 11, wherein the amine component is selected from the group consisting of ethylene diamine; hexamethylene diamine; a mixture of ethylene diamine and hexamethylene diamine; diethylene triamine; triethylene tetramine; pentaethylene hexamine; and a mixture of ethylene diamine and triethylene tetramine.

13. The bath of claim 12, wherein the mercaptoalkane compound is selected from the group consisting of 2-mercaptopropionic acid, 3-mercaptopropionic acid and 3-mercaptopropane sulfonic acid.

14. The bath of claim 13, wherein the palladium-ammine complex is $Pd(NH_3)_2(NO_2)_2$; the silver compound is $AgNO_3$; the amine component is ethylenediamine; the mercaptoalkane compound is 2-mercaptopropionic acid; and the conductive agent is tartaric acid.

15. A method of electrodepositing a palladium-silver alloy on a conductive substrate comprising electrodepositing a palladium-silver alloy from a bath of claim 1 at a current density of 0.5 to 10 A/dm$^2$ and a bath temperature of 20° to 80° C.

16. The bath of claim 1, wherein the conductive agent is selected from the group consisting of tartaric acid, citric acid, boric acid, ammonium bromide, ammonium chloride, ammonium nitrate and ammonium sulfate.

17. The bath of claim 1, wherein the palladium-ammine complex is $Pd(NH_3)_2(NO_2)_2$; the silver compound is $AgNO_3$; the conductive agent is selected from the group consisting of $NH_4NO_3$ and boric acid; the amine component is selected from the group consisting of triethylene tetramine and a mixture of diethylene triamine and pentaethylene hexamine; and the mercaptoalkane compound is selected from the group consisting of 2-mercaptopropionic acid and 3-mercaptopropionic acid.

18. The bath of claim 17, wherein the conductive agent is $NH_4NO_3$; the amine compound is triethylene tetramine; and the mercaptoalkane compound is 2-mercaptopropionic acid.

19. The bath of claim 17, wherein the conductive agent is $NH_4NO_3$; the amine compound is a mixture of diethylene triamine and pentaethylene hexamine; and the marcaptoalkane compound is 2-mercaptopriopionic acid.

20. The bath of claim 17, wherein the conductive agent is boric acid; the amine compound is diethylene triamine and the mercaptoalkane compound is 3-mercaptopropane sulfonic acid.

* * * * *